United States Patent [19]

Rooze et al.

[11] 4,300,616

[45] Nov. 17, 1981

[54] MANUFACTURE OF CAST-IRON INGOT MOULDS

[75] Inventors: Antonius J. Rooze, Heemskerk; Jan den Best, Bergen; Gerard J. Melman, Beverwijk, all of Netherlands

[73] Assignee: Estel Hoogovens BV, IJmuiden, Netherlands

[21] Appl. No.: 41,409

[22] Filed: May 22, 1979

[30] Foreign Application Priority Data

May 23, 1978 [NL] Netherlands ..... 7805541

[51] Int. Cl.[3] ..... B22D 27/04

[52] U.S. Cl. ..... 164/124; 164/348

[58] Field of Search ..... 164/122, 125, 66, 55, 164/12, 16, 6, 47, 348, 349, 371, 372, 41, 124

[56] References Cited

U.S. PATENT DOCUMENTS

| | | | |
|---|---|---|---|
| 1,025,436 | 5/1912 | West | 164/124 |
| 1,031,305 | 7/1912 | West | 164/124 |
| 1,056,961 | 3/1913 | West | 164/372 |

FOREIGN PATENT DOCUMENTS

| | | | |
|---|---|---|---|
| 1191076 | of 0000 | Fed. Rep. of Germany . | |
| 1060757 | 4/1954 | France | 164/66 |
| 1449052 | of 0000 | United Kingdom . | |
| 567542 | 8/1977 | U.S.S.R. | 164/349 |
| 582906 | 12/1977 | U.S.S.R. | 164/124 |

*Primary Examiner*—Robert D. Baldwin
*Assistant Examiner*—K. Y. Lin
*Attorney, Agent, or Firm*—Stevens, Davis, Miller & Mosher

[57] ABSTRACT

In casting of a cast-iron ingot mould in a sand mould, it is proposed to inject air into the moulding sand adjacent the lower end of the ingot mould, after the ingot mould surface has solidified. The injected air causes conversion of the perlite at the interior surface of the ingot mould into ferrite. This improves the resistance of this surface region to corrosion during casting of ingots in the ingot mould, thus prolonging the life of the ingot mould.

6 Claims, 3 Drawing Figures

MANUFACTURE OF CAST-IRON INGOT MOULDS

BACKGROUND OF THE INVENTION

1. FIELD OF THE INVENTION

The invention relates to a method of making cast-iron ingot moulds for use in casting steel ingots, wherein the ingot mould is cast in a sand mould. The invention also relates to an ingot mould made by the method and to a sand moulding box to be used in the method.

2. DESCRIPTION OF THE PRIOR ART

Steel ingots for steel rolling mills and steel forges are generally made by casting liquid steel into cast-iron ingot moulds. The liquid steel either falls into the ingot mould or is introduced at the lower end and rises up the mould, and the mass of the ingot mould is selected so that a major part of the melting heat of melting of the molten metal is led away into the ingot mould.

In order to manufacture ingots with smooth surfaces, proper condition of the interior surface of the ingot mould is important. As the ingot mould is used repeatedly, its inside surface is gradually attacked or corroded, with the particular danger of fast corrosion at the foot or lower end of the mould. This so-called flushing of the lower end of the ingot mould particularly occurs casting downward as a result of the first contact downward stream of liquid metal with the ingot mould. As the surface of the ingot mould becomes increasingly affected, the mould becomes less and less suitable for casting ingots and after a certain lapse of time it has to be rejected.

Ingot moulds themselves are manufactured by casting them into a partitioned sand mould. A sand moulding box has an interior casing and a bottom which for instance are made in one piece and are coupled to an exterior casing by means of a flange connection. Moulding sand is applied between the interior and exterior casings around a model of an ingot mould. The moulding sand is typically first mixed with a synthetic resin, for example a furane resin, so that proper cohesion of the moulding sand is achieved. During casting a major part of the synthetic resin carbonizes, so that the sand must be cleaned thoroughly before it can be re-used. A large proportion of the cost of manufacturing ingot moulds arises in regeneration of the moulding sand and in the cost of the resin consumed.

SUMMARY OF THE INVENTION

It is the object of the invention to provide an improved method of making an ingot mould.

It is furthermore an object of the invention to provide a method of making an ingot mould which is resistant to damage of its interior surface during use, and therefore has a longer useful life than conventional ingot moulds.

Another object of the invention is simplification of the sand regeneration needed after casting of an ingot mould and reduction of the amount of resin required in such casting.

According to the present invention, the method of making a cast-iron ingot mould by casting is characterized in that, after at least the interior surface of the ingot mould has solidified, gas is injected into the sand mould so as to contact the interior surface of the ingot mould adjacent the lower end thereof. The gas is most suitably air, and is preferably injected into the sand mould at one or more locations adjacent the lower end of the interior surface of the ingot mould.

It is particularly preferred that the amount of air injected is sufficient to cause, at least on the inside surface of the lower end of the ingot mould, conversion of perlite into ferrite by decarbonization. It has appeared that air injected close to the inside of the ingot mould lower end, rises slowly through the moulding sand and will cause a certain amount of decarbonization of the interior surface of the ingot mould. The conversion of the cast iron structure on this surface from perlite into ferrite results in an extension of the useful life of the ignot mould. The ferritic surface is less susceptible to damage in "flushing" of the mould surface during pouring of an ingot. Thus not only can the ingot mould be used a number of times, but considerably better ingots can be obtained.

These results can be achieved using conventional casting sand. An additional advantage can however be obtained if use is made of a sand mould in which the sand is bonded by an organic synthetic resin. It has already been noted that furane resins can generally be used for this purpose. Passing air through the hot sand body results in a thermal regeneration of the sand. At the temperature of the sand at this stage the remainder of furane resin, as well as the carbon derived from it by cracking, can be burnt and escape as a gas. This immediately results in a volume-reduction of the sand, while at the same time its cohesion decreases. This produces a considerable simplification of the so-called "stripping" of the ingot mould. After stripping, the sand proves to be notably cleaner than would have been the case if air were not passed through it. Regeneration of the sand can consequently be carried out in a considerably simpler manner, while the sand grains suffer less as well in this regeneration. In its turn this leads to greater strength of the regenerated sand which means that less resin is needed overall if the sand is used repeatedly. Thus the invention can provide not only economy in the consumption of ingot moulds per ton of steel cast in them, but also there is saving in resin per ton of ingot mould.

It will be clear that the amount of air blown into the sand, and the period of time for which it is blown, are to be adapted to the weight and the shape of the ingot mould. Nevertheless it has appeared that for most ingot moulds good results are achieved if the amount of air introduced is 30 to 40 $m^3/h$ for 8 to 14 hours, starting 2 to 4 hours after the completion of casting.

U.K. patent specification No. 1,449,052 describes a process of heat treatment of an ingot mould by heating it in an electrically heated furnace, so as to anneal the outer parts of the mould into ferrite, while the inner surface of mould is cooled with air so that it retains its perlite structure. This is quite different from the present invention where the air contacts the ingot mould in its sand mould following casting, and the inner surface is converted to ferrite.

German patent specification DAS No. 1 191 076 describes an ingot mould in which the inner surface is of perlite with fine-grained graphite, while the outer surface is ferrite. This again is different from the present invention. It is proposed in this German specification to perform shock-cooling of the inner surface of the mould by means of a gas stream after casting of the mould and following removal of the moulding core. In the present invention, in contrast, the air is injected into the moulding sand within the cast ingot mould.

The moulding box according to the invention is characterised by, adjacent the lower end of its interior casing, a conduit, e.g. a ring conduit with uniformly, e.g. equally, spaced holes for the introduction of gas into the moulding sand.

INTRODUCTION OF THE DRAWINGS

An embodiment of the invention will now be described by way of non-limitative example with reference to the accompanying drawings, in which.

DESCRIPTION OF THE PREFERRED EMBODIMENT

Figure 1:
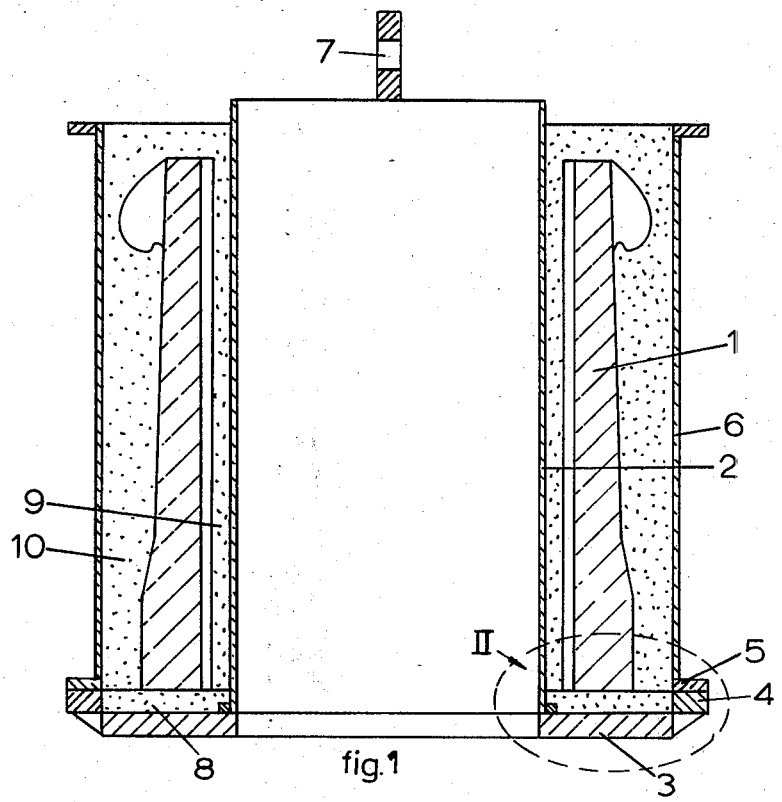
FIG. 1 is a schematic longitudinal section of an ingot mould in a sand moulding box.

FIG. 1 shows an ingot mould 1 within a filled sand moulding box which has an interior casing 2 and an exterior casing 6. The interior casing 2 is a vertical shell which is fitted to a bottom 3, to which in its turn an exterior flange 4 is welded. Further a support eye 7 is fitted to the inside casing to allow it to be lifted. The ingot mould 1 is enclosed within the moulding box between sand bodies 8,9 and 10. The sand body 8 is beneath the foot or lower end of the ingot mould, while the bodies 9 and 10 are respectively between the ingot mould and the interior casing 2, and between the ingot mould and the exterior casing 6. The manner in which the sand bodies are moulded and arranged with the aid of a model is well-known to an expert, and therefore need not be described here.

After the sand bodies have been moulded, and the moulding box has been constructed with the aid of a model which is then removed, molten iron is poured into the hollow created by the model, after which this cast-iron is allowed to cool gradually.

Figure 2:
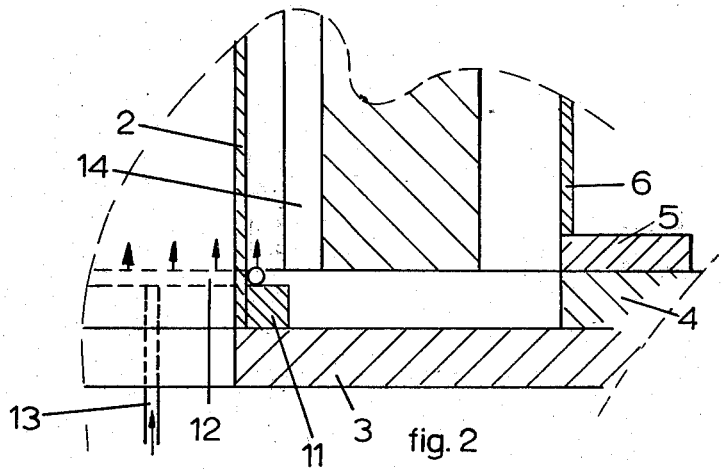
FIG. 2 shows on an enlarged scale the detail denoted by II in FIG. 1.

FIG. 2 shows that the interior shell 2 and the base plate 3 are connected to each other by means of a stiffening ring 11. A ring conduit 12 is located above the stiffening ring 11 against the interior shell 2. This conduit or pipe 12 is connected to a supply 13 for compressed air. The top side of the conduit 12 is provided with holes through which compressed air can be forced into the moulding sand in use of the moulding box, so that the air comes into contact with at least the lower end of the interior surface of the ingot mould, i.e. the surface contacted by steel being moulded in the ingot mould.

To give a specific example of the process of the invention, an ingot mould of about 23 tons was cooled for three hours after the end of pouring until its surface wall had solidified. Thereafter, compressed air at an overpressure of 5 kg/cm$^2$ was blown into the sand from the conduit 12 during a period of 10 to 12 hours at a rate of about 35 m$^3$/h.

A mixture of quartz-sand and furane resin was used as the moulding sand; the major part of the furane resin burned and escaped as a gas while the air was being passed into the sand. The remainder of excess air was sufficient to decarbonize the inside surface of the ingot mould sufficiently that the perlite structure at this surface was converted into ferrite.

It has appeared that depending on other circumstances, this improvement of the structure of the ingot mould may lead to saving in ingot mould consumption in the range of 5 to 10%.

Because of the additional cooling resulting from blowing air through the sand, it proved possible to remove the ingot mould from the moulding box two hours earlier. This removal was also quicker and simpler because the moulding sand was reduced in volume and looser, as a result of the air. The resulting sand proved to be markedly cleaner than is the case when air is not passed through the sand, so that the sand is more suitable for re-use. The higher residual strength of the sand used may under certain circumstances make possible a reduction of the resin consumption.

Figure 3:
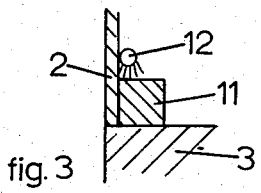
FIG. 3 shows a detail from FIG. 2 in a modified embodiment of the invention.

Improved distribution of the airflow through the sand mass can also be obtained by making the holes in ring conduit 12 at the bottom side of the conduit 12, as FIG. 3 illustrates.

What is claimed is:

1. A method of making a cast-iron ingot mould for use in casting steel ingots, comprising the steps of (a) casting molten iron into a sand mould composed of quartz sand and furane resin of shape adapted to form the ingot mould, (b) allowing at least the iron at the interior surface of the cast ingot mould to solidify and (c), immediately after step (b), introducing oxygen-containing gas at an overpressure of 5 kg/cm$^2$ into the sand mould adjacent the interior lower end of the ingot mould for a period of from 10–12 hours at a rate of 35 m$^3$/h so that the gas contacts the interior surface of the ingot mould in an amount sufficient to cause conversion of perlite into ferrite by decarbonization, at least at the lower end of the interior surface of the ingot mould.

2. A method according to claim 1 wherein the said gas is air.

3. In a method of making a cast-iron ingot mould for use in casting steel ingots, wherein the ingot mould is cast in a sand mould bonded by an organic synthetic resin, the improvement that, immediately after at least the interior surface of the ingot mould has solidified, oxygen-containing gas at an overpressure of 5 kg/cm$^2$ is injected into the sand mould for a period of from 10–12 hours at a rate of 35 m$^3$/h so as to contact the interior surface of the ingot mould adjacent the lower end thereof in an amount sufficient to cause conversion of perlite into ferrite by decarbonization, at least at the lower end of the interior surface of the ingot mould.

4. Method according to claim 3 wherein the gas is injected into the sand mould at a location adjacent the lower end of the interior surface of the ingot mould.

5. Method according to claim 3 wherein the injected gas is air.

6. A method of making a cast-iron ingot mould for use in casting steel ingots, comprising the steps of (a) casting molten iron into a sand mould composed of quartz sand and furane resin of shape adapted to form the ingot mould, (b) allowing at least the iron at the interior surface of the cast ingot mould to solidify and (c), immediately after step (b), introducing oxygen-containing gas at an overpressure of 5 kg/cm$^2$ into the sand mould adjacent the interior lower end of the ingot mould so that the gas contacts the interior surface of the ingot mould, 30 to 40 m$^3$/h of gas being injected into the sand mould for a period of 8 to 14 hours, commencing 2 to 4 hours after completion of pouring.

* * * * *